US007838081B2

(12) United States Patent
Seeger

(10) Patent No.: US 7,838,081 B2
(45) Date of Patent: Nov. 23, 2010

(54) LIQUOR THAT AVOIDS THE APPARITION OF STAINS PRODUCED BY FUNGI IN LIGNOCELLULOSIC MATERIALS SUCH AS WOOD

(76) Inventor: Burkhard Julin Seeger, Gleisner 1814, Concepión (CL)

( * ) Notice: Subject to any disclaimer, the term of this patent is extended or adjusted under 35 U.S.C. 154(b) by 920 days.

(21) Appl. No.: 11/476,799

(22) Filed: Jun. 29, 2006

(65) Prior Publication Data

US 2007/0033826 A1 Feb. 15, 2007

(30) Foreign Application Priority Data

Jun. 30, 2005 (CL) ..... 1636-2005

(51) Int. Cl.
*B05D 1/18* (2006.01)

(52) U.S. Cl. ..... 427/440; 427/439; 427/297

(58) Field of Classification Search ..... 427/430.1, 427/439, 440, 408, 325
See application file for complete search history.

(56) References Cited

U.S. PATENT DOCUMENTS

| | | | | |
|---|---|---|---|---|
| 4,737,154 | A * | 4/1988 | Gaines et al. | 8/402 |
| 2004/0105938 | A1 * | 6/2004 | Seeger Stein | 427/440 |
| 2004/0166246 | A1 * | 8/2004 | Holcomb | 427/440 |

FOREIGN PATENT DOCUMENTS

WO WO 2006072672 A1 * 7/2006

* cited by examiner

*Primary Examiner*—David Turocy
(74) *Attorney, Agent, or Firm*—Banner & Witcoff, Ltd.

(57) ABSTRACT

Treatment process of wood and lignocellulosic materials with an aqueous liquid that contains alkaline oxalate and benzoate, which, in contact with humid or dry wood, avoids the formation of the blue stain and stains of other colors produced by fungi. This way it avoids the strong devaluation of the stained wood and has advantages on compounds used for that aim at the present time.

13 Claims, 9 Drawing Sheets

Nonefficient inhibitor (a)

Copper hidroxiquinolinate, PQ-8

(b)

Borate Silicate (BS)

(c)

Oxalate Benzoate (d)

LIQUOR THAT AVOIDS THE APPARITION OF STAINS PRODUCED BY FUNGI IN LIGNOCELLULOSIC MATERIALS SUCH AS WOOD

FIELD OF THE INVENTION

The invention refers to the use of a liquid that, in contact with humid or dry wood, avoids the formation of the blue stain and stains of other colors (red, yellow, green and others) produced by fungi. This way it avoids the strong devaluation of the stained wood and has advantages on compounds used for that aim at the present time.

BACKGROUND OF THE INVENTION

The fresh cutted wood and the one with a humidity superior to 30%, stains with blue color, color that predominates generally, but also can acquire stains of other colors, like yellow, red, green and white. This phenomenon is more pronounced in a humid climate and not in a very cold one. The stains appear specially due to the growth of the fungi: 1) *Ceratocystis* species, like *pilifera C., C. piceae* (blue stain), 2) *Ophiostoma* species (blue stain), 3) *Antirhynium* sp. (blue stain), 4) *Aureobasidium* species (yellow stain) and 5) *Fusarium* sp. species (red stain).

The formation of stains in the sawed wood is a serious problem for the distant sawmills, where the tables and planks have to be piled up until being transported to the commercial centers where they will be used, because these stains can already appear in few days. Also, during the transport of humid wood in the store-rooms of ships, a fast appearance of the stains is caused by the fungi. This means a serious economic problem for Chile, which is a great exporter of wood to distant countries like United States, Europe, Arabia and Far East.

The exposed facts and the International Norms have motivated the search of solutions for the elimination of the phenomenon of the stains in the wood, which appearance means an obviously diminution of the price of the affected lignocellulosic products. There have been intents to fight the formation of stains by submerging the wood in liquids or by sprinkling liquids with different inhibitors of the growth of the fungi.

One of first compound which obtained good results was chloroorganic Pentachlorophenol. Nevertheless, already in the early 90s, its use was prohibited for its great toxicity (mutagenic, cancerogenic, liver damages). In general the chloroorganic compounds had great importance for their properties like fungicides, insecticides, plaguicides in general and chemical arms, but actually many of them had to be withdrawn of the market. Further the mentioned chloroorganics release the chlorodioxines to the environment, which enormous toxicity restricts even more the use of these chloroderivatives.

After that Pentachlorophenol was replaced by Tribromophenol, which obtained good results in the combat against the stains of the wood, but subsequently it was possible to verify that the bromocompounds also have a high toxicity. For that reason Tribromophenol has been replaced recently by compounds like Copper oxiquinolinate, PQ-8, also toxic, although also nonvolatile, actually very used. Oxiquinolinate is used together with Carbendiazime to reinforce its action. Metiolenbis-tiocianate/2-(T-Benzothiazol) is also used. All these substancies produce health problems (see table 1).

Among the disadvantages of Copper oxiquinolinate, PQ-8, can be mentioned in addition, that it has a relatively high price and that it dyes the wood yellow.

During the development of a process of accelerated petrifaction of wood and in general of lignocellulosic materials, patent request number 1332-2001, patent request number 2746-2002 and US publication number 2004/0105938 A1, (Jun. 3, 2004), could be observed that the liquid used for the treatment not only prevented the combustion of the wood, its putrefying and the attack of the termites, but also prevented the formation of stains by fungi. Afterwards studies were made to avoid the formation of stains by the treatment of the wood and in general of lignocellulosic material with liquids of a similar composition, including substances which nature allowed to suppose an utility. The realized tests allowed to choose a mixture of large shredss and alkaline benzoates in an middle alkaline medium as the most powerful inhibitors of the staining fungi. These ions also can be used besides the ions which are ingredients of the petrifaction of the wood, borates and silicates.

TABLE 1

Toxicity of comercial antistain substances

| | 2,4,6 Tribromophenol | Copper 8 oxiquinolinate (PQ-8) | Carbendiazime/ Copper 8 oxiquinolinate | Metiolenbistiocianate/ 2-(T(Benzothiazol)) |
|---|---|---|---|---|
| LD50 acute oral rat: | >5.000 mg/kg | 3.900-4.700 mg/kg | 861 mg/kg | 280 mg/kg |
| LD50 acute termal rabbit: | >8.000 mg/kg | >2.000 mg/kg | 2.020 mg/kg | 1.670 mg/kg |
| Irritating or corrosive to: | Eyes, mucous and respiratory system | Eyes and skin | Eyes and skin | Eyes and skin |
| Formation of dioxines: | YES | NO | NO | NO |

BRIEF SUMMARY OF THE INVENTION

The proposed ingredients have not been used yet to avoid the formation of the blue stain nor stains of another color produced by fungi.

DETAILED DESCRIPTION OF THE INVENTION

The presented invention refers to a aqueous liquid that contains oxalate and benzoate ions in an alkaline medium. To this liquid can be added borate or borate and silicate. Even a solution that contains only oxalate and borate can be used. The best results were obtained with oxalate and alkaline benzoate in an alkaline medium. When the recently cutted wood and in general lignocellulosic material, humid or dry, is bathed or sprinkled or moistened its surface in another form by all these liquids, they avoid the coloration by formation of stains produced by fungi, like:

*Ceratocystis pilifera* (blue stain), 2) *Antirhynium* sp. (blue stain), 3) *Aureobasidium* sp. (yellow stain) and 4) *Fusarium* sp. (red stain).

The treated wood remains clean. This indicate the studies made in the laboratory, where the mentioned fungi are artificially inoculated to plates of agar agar in for their growth ideal conditions of temperature and humidity, which contain little pieces of pine wood. Furthermore this results were corroborated by tests in industrial scale. For this tables of two meters forty of length by one by four inches and large shreds of three meters twenty of length by two by two inches, partly treated with the protective liquid and partly without treatment. A part of the humid wood was left outdoors during the month of June with abundant rain and humidity, another part of the humid wood was covered with a polyethylene awning (see pictures).

Formation of stains was not observed in a period of more than 3 weeks from the applied bath. However, the treated wood presented abundant formation of stains, with 70 to 90% of the surface stained.

EXAMPLE

The inhibiting effect of the stains produced by fungi was studied in pine wood. This wood is very sensitive to the attack of the staining fungi, but it is also the most produced and exported wood in great scale in Chile (almost 90%).

Figure 1:
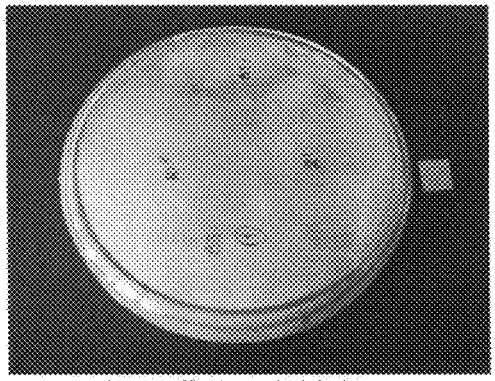
FIG. 1 shows the results of some tests with the staining fungus *Ceratocystis pilitera* (blue stain) after 15 days.
Figure 1:
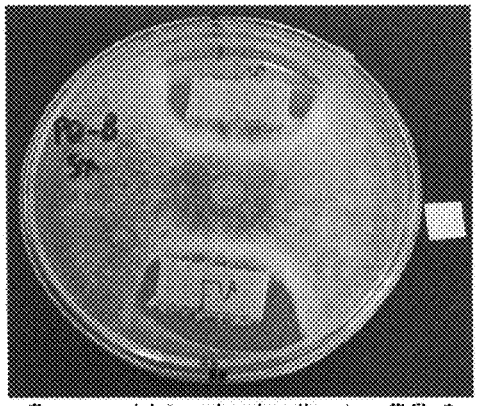
Figure 1:
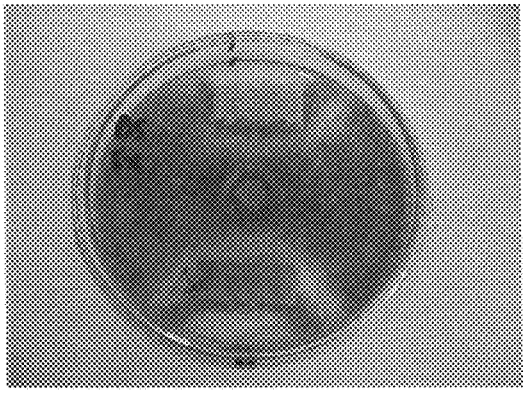
Figure 1:
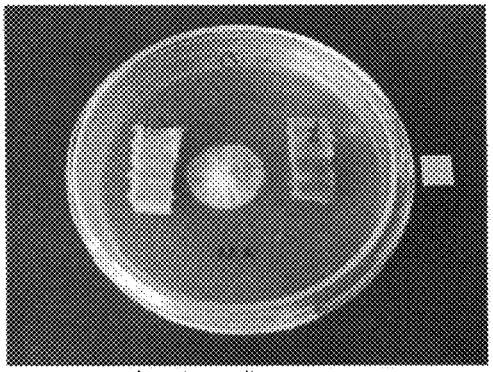
Figure 2:
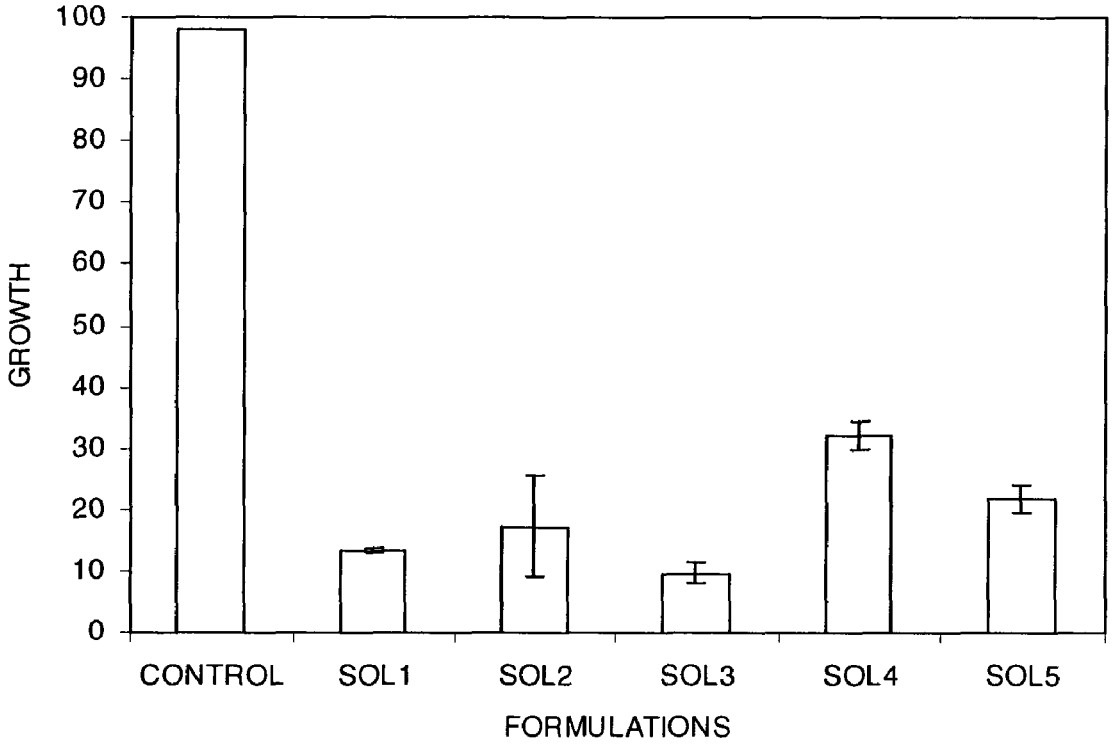
FIG. 2 shows the effect of the treatment of the staining fungus *Aureobasidium* sp. after a period of incubation of 30 days.
Figure 3:
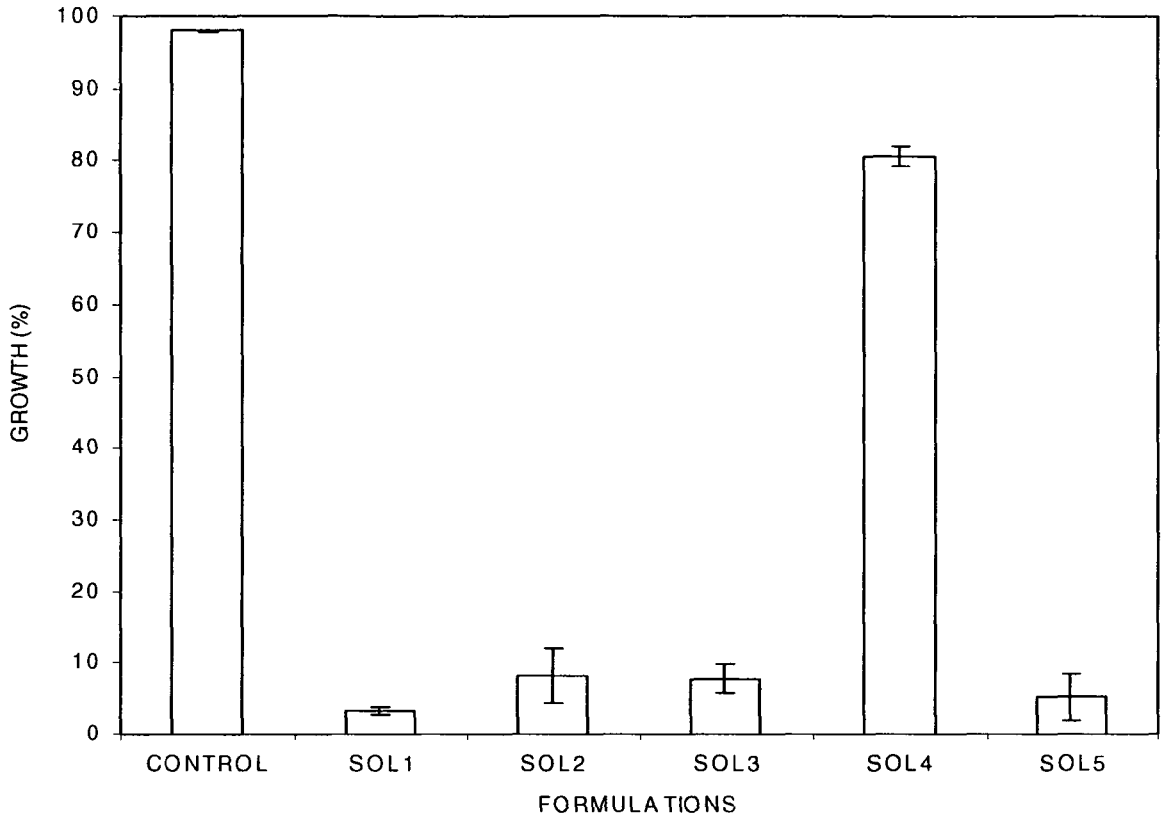
FIG. 3 shows the effect of the treatment of the staining fungus *Certocystis pilifera* after a period of incubation of 30 days.

Studies of the inhibiting effect of the stains produced by fungi were made on laboratory and industrial scale. In the studies on laboratory scale two pieces of wood of 25 mm×3 mm×3 mm were placed in a Petri plate of 100 mm diameter with agar agar. One of the pieces had been treated during 10 seconds with the protective liquid and the other during 2 minutes. There were no difference between the time of treatment and the effect of the fungi. In the center of the Petri plate there were placed a drop with the culture of the staining fungus. It is incubated during 30 days at 25° C. in darkness. The results of some typical tests with the staining fungi *Ceratocystis pilifera* (blue stain1), *Antirhynium* sp. (blue stain), *Aureobasidium* sp. (yellow stain) and two types of *Fusarium* sp. (red stain) can be observed in the attached FIGS. 1*a*) and 1*d*):

The results derived from a great amount of tests that contained single salts, combination of two salts, combination of three salts or combination of four salts, all in alkaline medium, with the 5 types of fungi that most frequently produce stains, demonstrated that the most effective solutions were the chosen ones, all with oxalate as ingredient.

Solution 1: oxalate, benzoate, borate, silicate
Solution 2: oxalate, benzoate, borate
Solution 3, oxalate, benzoate
Solution 4: benzoate, borate
Solution 5: oxalate, borate The time of incubation was 30 days at 25° C. in darkness.

Figure 4:
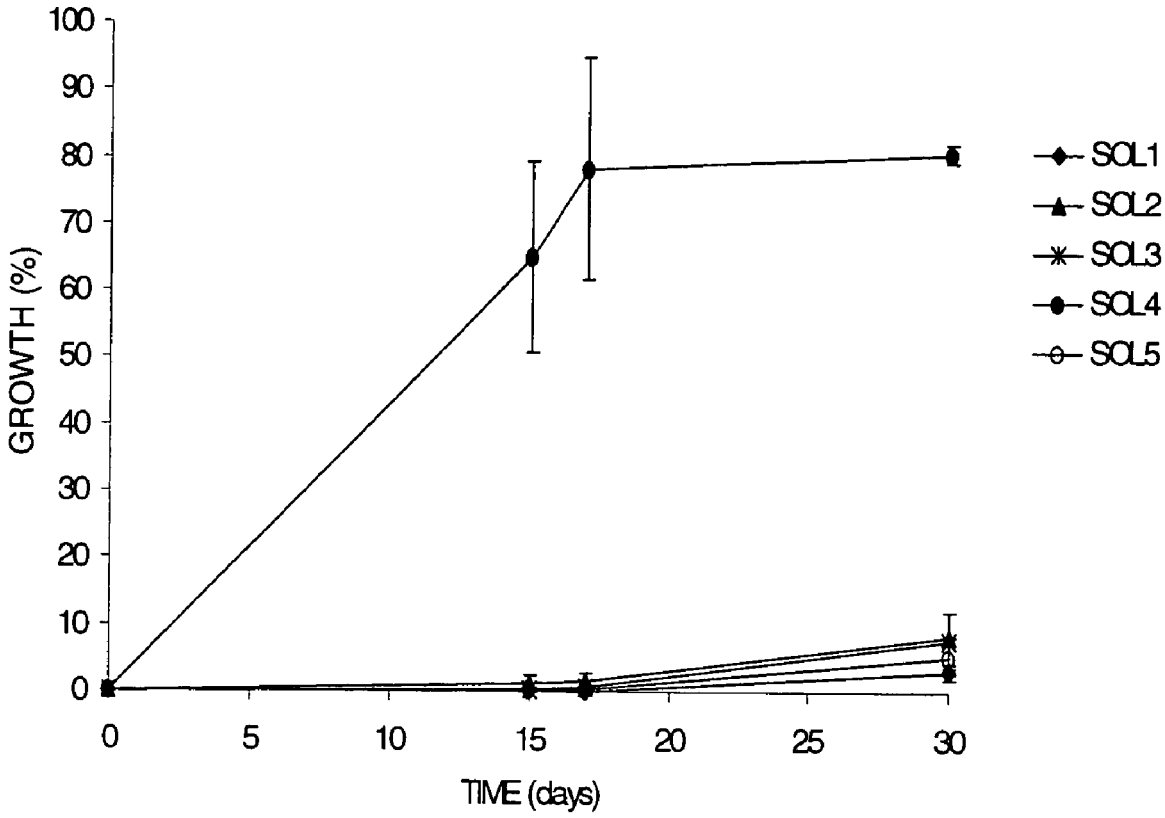
FIG. 4 shows the growth kinetic of the staining fungus *Ceratocystis pilifera* (blue stain).
Figure 5:
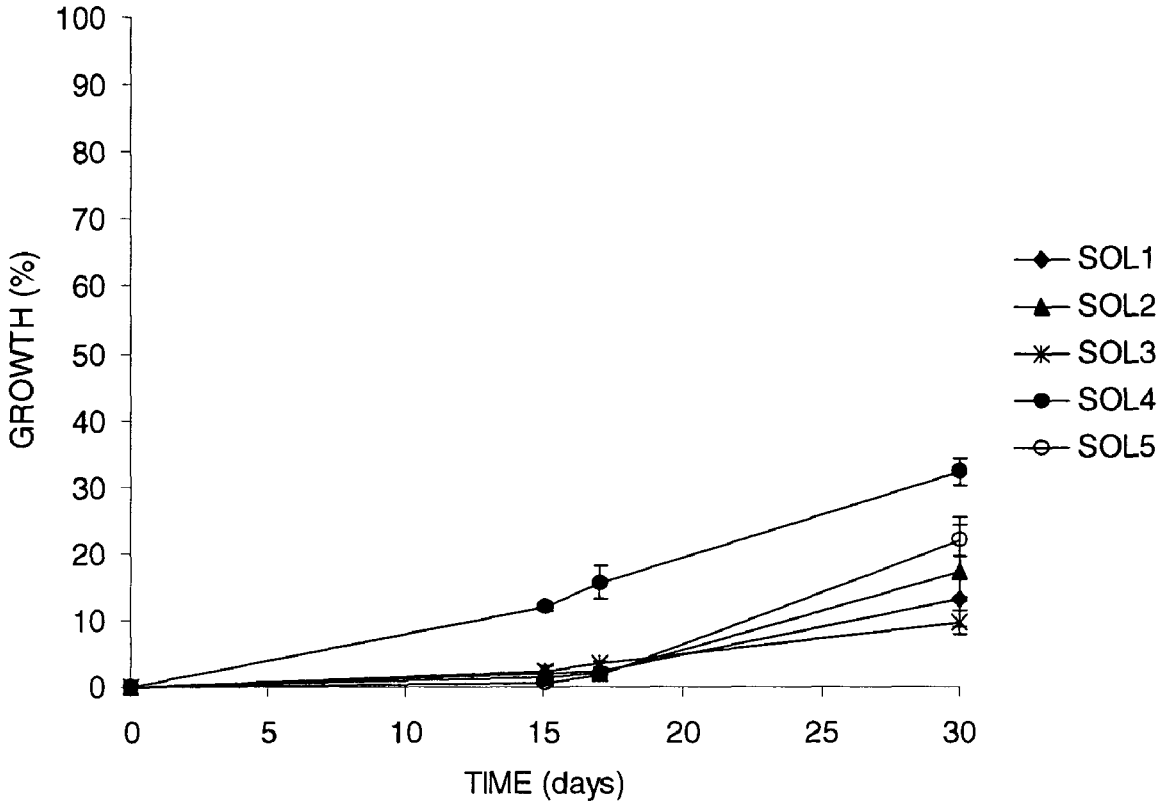
FIG. 5 shows the growth kinetic of the staining fungus *Sureobasidium* sp.
Figure 6:
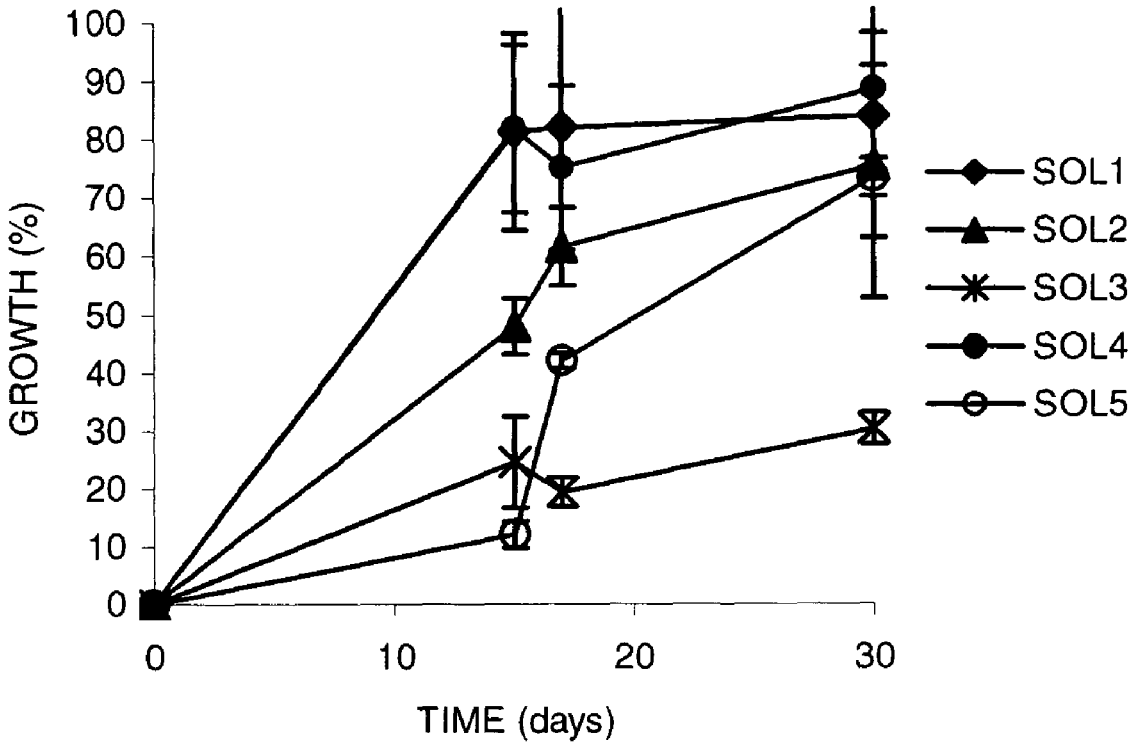
FIG. 6 shows the growth kinetic of the staining fungus *Fusarium* sp. (2)

The same way the growth kinetic of the different staining fungi was studied. Examples of the growth kinetic of the same fungi shown in the first two graphics can be seen at FIGS. 4, 5 and 6.

Figure 7:
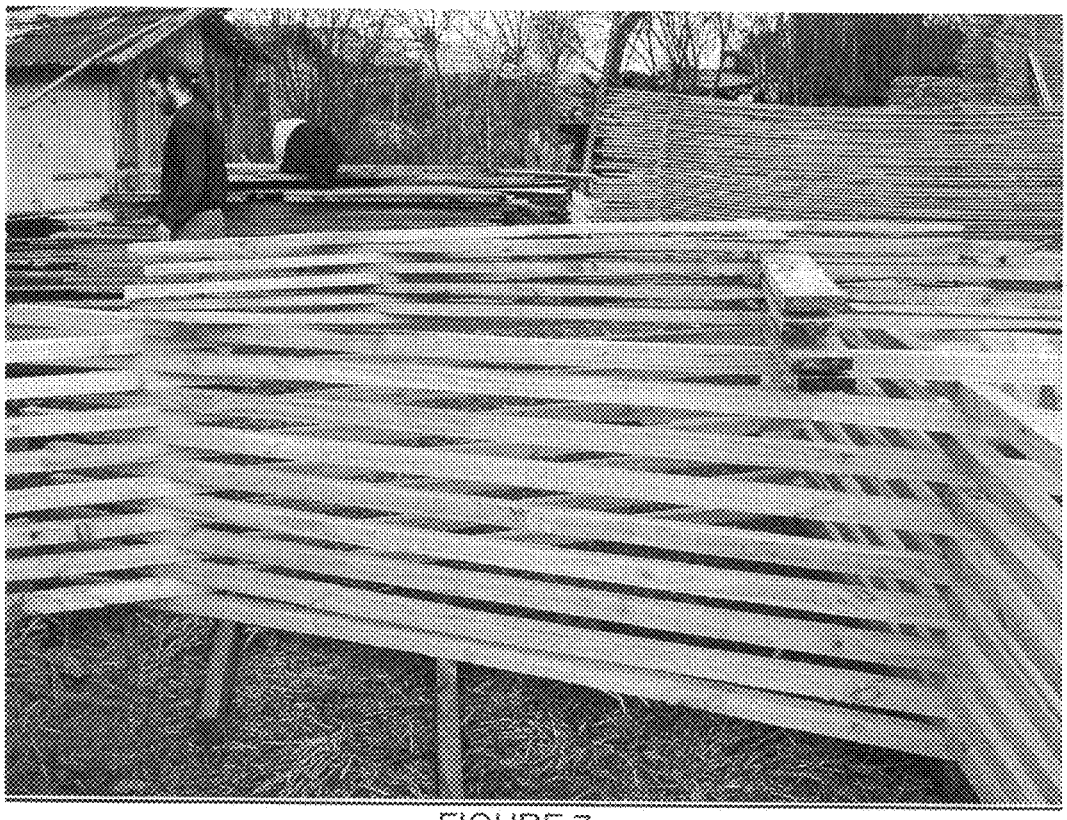
FIG. 7 is a picture of the industrial test with large shreds of 3.2 m and 2×2", exposed to a bath in antistains large oxalates-benzoate.
Figure 8:
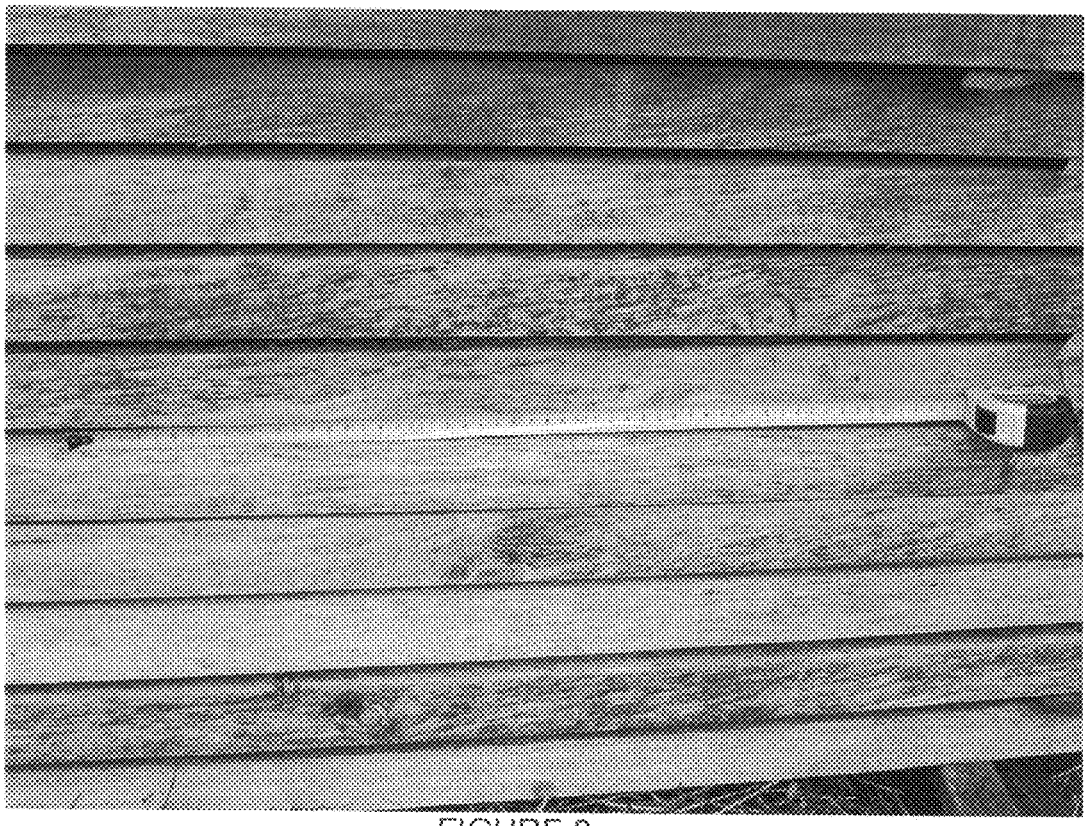
FIG. 8 is a picture of the industrial test with large shreds of 3.2 m and 2×2", without treatment (control).
Figure 9:
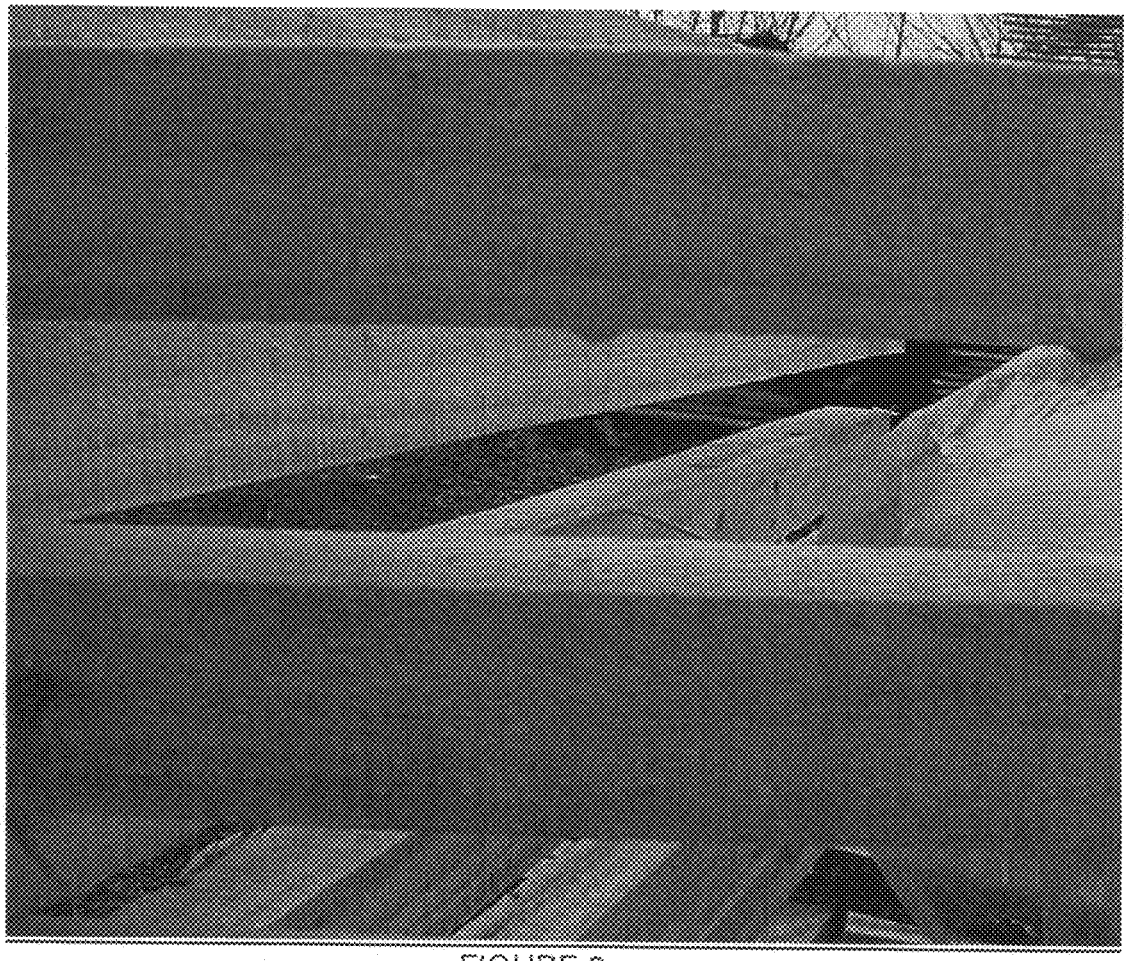
FIG. 9 is a picture of the industrial test with large shreds of 3.2 m and 2×2", exposed to a bath in antistains large oxalates-benzoate.
Figure 10:
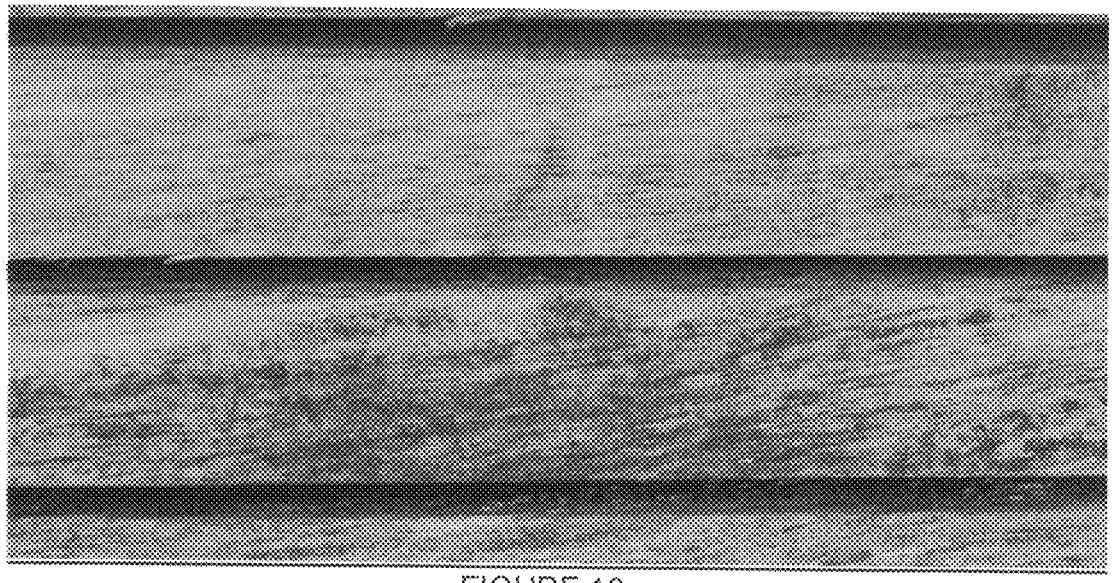
FIG. 10 is a picture of the industrial test with large shreds of 3.2 m and 2×2", without treatment (control).
Figure 11:
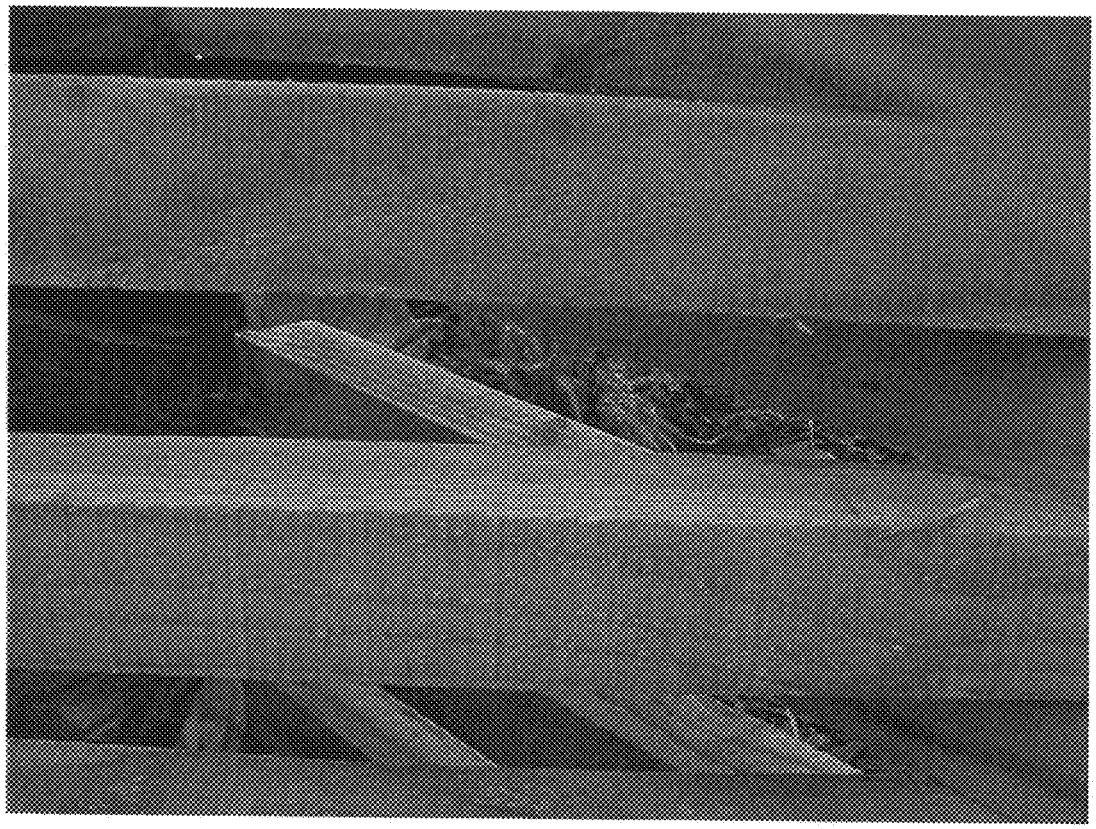
FIG. 11 is a picture of the industrial test with large shreds of 3.2 m and 2×2", bathed with large oxalates-benzoate anti-stain liquid.
Figure 12:
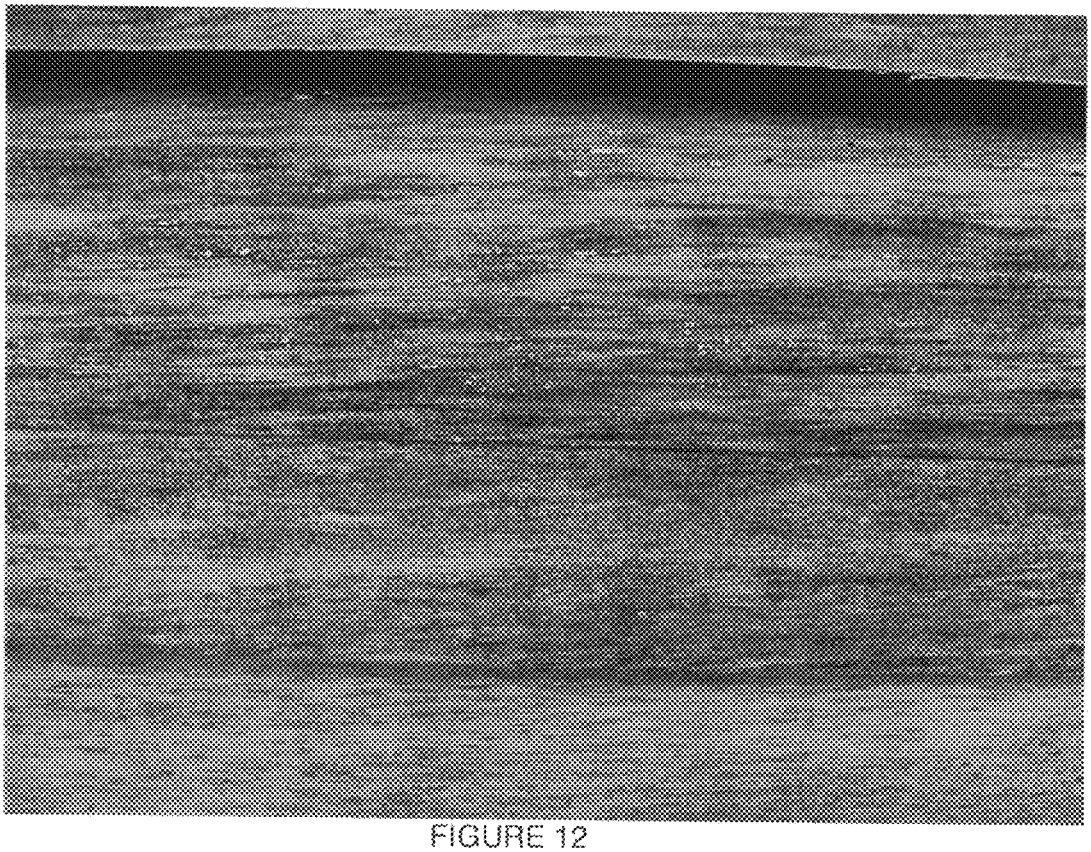
FIG. 12 is a picture of the industrial test with large shreds of 3.2 m and 2×2", without treatment (control).

The last industrial tests with tables and planks were made only during a little more than two weeks, but in a very humid month and they did not show evidence of stains, which can be observed in the attached pictures of FIGS. 7 and 12.

It is assumed that the wood treated with the indicated salts will continue with an antistain effect on a long term. No stains appeared in the material impregnated with a liquid of borate silicate, which was elaborated in a previous project, material that maintaines outdoors since 2001 until today as sticks, tables and bridges in several places in the Bío Bío Region. The liquid that contains oxalate and benzoate has demonstrated to have an inhibiting effect very superior to the one of BS system (borate silicate) in the laboratory tests. Therefore, solutions of oxalate and benzoate, that also can be used mixed with borate and silicate or only with borate must maintain the lignocellulosic material clean and specially the wood in the time required by the wood industry.

LITERATURE

George Agrios, 1996. Fitopatología, 821 pp. Ed. Limusa. Mexico.

Fernandez Valiela. 1979. Introducción a la fitopatología. Vol 4: Hongos y Mycoplasmas. 595 pp. Ed. Colección científica INTA. Argentina Anónimo. 1988. La mancha azul. Recursos (Mérida) 31:17.

Cartwright, K. S. T. and Findlay, W. P. K. 1958. Decay of timber and its prevention. 2nd. ed. London. H. M. S. O. 450 pp.

Findlay, W. P. K. and Pettifor, C. B. 1939. Effect of blue stain on the strength of Obeche (*Triplochiton scleroxylon*). The Empire Forestry Journal 18:259-267.

Gómez, R. y Benitez, R. F. 1989. Compendio sobre insectos y hongos que atacan la madera. Tatascán 6:31-38.

Junta del Acuerdo de Cartagena. 1988. Manual del grupo andino para la preservación de maderas. Lima, Perú, Pridmadera. 414 pp.

Laboratorio de Anatomáde Maderas. 1979. Guía de procedimientos de coloración. Universidad de Los Andes. Mérida. 11 pp. (Multigrafiado).

Lambeth, C., Osorio, G. and Osorio, L. F. 1989. Blue stain incidence in commercial plantation species in Colombia. Smurfit Cartón de Colombia. Investigación Forestal. Research Report 122. 8 pp.

Mohali, S. 1992. Aplicación de baños profilácticos para la prevención del manchado azul en madera aserrada de Pino Caribe. Revista Forestal Latinoamericana 8:51-64.

Mohali, S., Cedeño, L. y Palacios-Prü, E. 1992. Ultraestructura del manchado azul del pino caribe causado por el hongo *Botryodiplodia theobromae*. Memorias del ler Congreso Atlántico de Microscopía Electrónica. Mérida, Venezuela. pp. 260-261.

Mullen, J. M. 1987. *Botryodiplodia theobromae*, a stress pathogen of dog wood (*Cornus florida*). Phytopathology 77:1733.

Olofinboba, M. O. 1973. The use of anti-transpirants in controlling blue-stain infection in *Antaris africana*. Ghana Journal of Science 13:155-161.

Olofinboba, M. O. 1974. Sap stain in *Antaris africana*, an economically important tropical white wood. Nature 249: 860.

Punithalingam, E. 1980. Plant diseases attributed to *Botryodiplodia theobromae* Pat. Bibliotheca mycologica. Baud 71. Vadua. J. Cramer. pp. 61-64.

Lignum, 1999. Para combatir la mancha azul, alternativas más ecológicas. Revista Forestal, 42: 13-14.

J. A., Von Arx, 1979. The genera of Fungi Sporulating in Pure culture. Ed. J. Cramer. 549 pp.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

I claim:

1. A treatment process of wood or lignocellulosic material that prevents the formation of blue stains and stains of other colors produced by fungi, comprising wetting the surface of the wood or lignocellulosic material with an aqueous liquid comprising alkaline oxalate and benzoate.

2. The treatment process of claim 1 further comprising adjusting the pH of the aqueous liquid to between 10 and 13 with alkaline hydroxide.

3. The treatment process of claim 1 wherein the alkaline is sodium.

4. The treatment process of claim 1 wherein the alkaline is potassium.

5. The treatment process of claim 1 wherein the concentration of the oxalate and of the benzoate in the liquid is between 0.5 and a saturated solution.

6. The treatment process of claim 5 wherein the concentration is between 1.5 to 2.5%.

7. The treatment process of claim 1 wherein the aqueous liquid further comprises alkaline metaborate.

8. The treatment process of claim 1 wherein the aqueous liquid further comprises alkaline metaborate and silicate.

9. The treatment process of claim 1 further comprising preparing the alkaline metaborate from boric acid and alkaline hydroxide.

10. The treatment process of claim 1 further comprising preparing the alkaline metaborate by treatment of alkaline tetraborate with alkaline hydroxide.

11. The treatment process of claim 1 further comprising introducing the wood or the lignocellulosic material in a bath of the liquid, in manual manner, mechanized in line or stationary.

12. The treatment process of claim 1 further comprising sprinkling the liquid on the surface of the wood or the lignocellulosic material.

13. The treatment process of claim 1 further comprising sweeping the surface of the wood or the lignocellulosic material with brushes soaked with the liquid.

* * * * *